US006171176B1

(12) United States Patent
Kajiyama et al.

(10) Patent No.: US 6,171,176 B1
(45) Date of Patent: Jan. 9, 2001

(54) METHOD OF EFFECTING A PRECISION SAW-TOOTHED GRINDING ON THE SURFACE OF A GIVEN WORKPIECE

(75) Inventors: Keiichi Kajiyama; Kazuma Sekiya, both of Tokyo (JP)

(73) Assignee: Disco Corporation, Tokyo (JP)

( * ) Notice: Under 35 U.S.C. 154(b), the term of this patent shall be extended for 0 days.

(21) Appl. No.: 09/395,174

(22) Filed: Sep. 14, 1999

(30) Foreign Application Priority Data

Sep. 24, 1998 (JP) ..... 10-269427

(51) Int. Cl.[7] ..... B24B 1/00

(52) U.S. Cl. ..... 451/28; 451/53; 451/128; 451/182; 451/188; 451/449; 451/450

(58) Field of Search ..... 451/28, 53, 178, 451/182, 184, 188, 449, 450

(56) References Cited

U.S. PATENT DOCUMENTS 5,214,881 * 6/1993 Borchardt ..... 451/188

6,084,175 * 7/2000 Perry et al. ..... 136/256

* cited by examiner

*Primary Examiner*—David A. Scherbel
*Assistant Examiner*—Shantese McDonald
(74) *Attorney, Agent, or Firm*—Arent Fox Kintner Plotkin & Kahn, PLLC

(57) ABSTRACT

Disclosed is an improved method of forming a series of hills and valleys alternately arranged at a predetermined pitch on the surface of a given workpiece. It comprises the steps of: carrying out a first grinding on the workpiece with a saw-toothed grindstone having a series of hills and valleys alternately arranged at "N" pitches ("N" being two or more integer or whole number), the height measured from the bottom of the valley to the peak of the hill in the saw-toothed grindstone being taller than the corresponding height in the workpiece; moving the saw-toothed grindstone and/or the workpiece one pitch relative to each other to carry out a second grinding on the workpiece; and repeating the relative movement of one-pitch long-distance and sequential grinding until the final "N"th grinding has been finished. All grindings are effected while the workpiece is being cooled by cooling water.

3 Claims, 4 Drawing Sheets

METHOD OF EFFECTING A PRECISION SAW-TOOTHED GRINDING ON THE SURFACE OF A GIVEN WORKPIECE

BACKGROUND OF THE INVENTION

1. Field of the Invention

The present invention relates to a surface-shaping method, and more particularly to a method of forming a series of hills and valleys alternately arranged at a predetermined pitch on the surface of a given workpiece.

2. Related Arts

Referring to FIG.7, a solar cell 50 has minute hills 51 and valleys 52 alternately formed on its surface, thereby increasing the solar absorption rate and accordingly the rate at which electric power can be produced from sunlight.

A drum-like grindstone 55 having pulverized diamond deposited on its surface is fixed to a rotary spindle 56. The drum 55 has a series of hills 51 and valleys 52 alternately arranged at the same pitches P of peak 54-to-peak 54 intervals (or bottom 53-to-bottom 53 intervals) as the solar cell 50, which is to be provided. The height H measured from the bottom 53 of the valley 52 to the peak 54 of the hill 51 in the drum 55 is equal to the corresponding height measured in the solar cell. In short, the drum 55 has the same saw-toothed pattern as the solar cell, so that the saw-toothed pattern may be transferred from the grindstone 55 to the workpiece W.

In making the saw-toothed grooves on the workpiece W the hill-and-valley arrangement of the grindstone 55 is pushed against the surface of the workpiece. The machining gap remaining therebetween, therefore, decreases gradually toward the tight fit. Accordingly the grinding resistance increases with increase of the bite amount. Also, it is increasingly difficult that the cooling water flows into the ever decreasing gap. Finally, no cooling water is permitted to reach the blade-and-workpiece contact. The solar cell thus produced is of lower quality.

In transferring the valleys from the grindstone to the workpiece to form the corresponding hills therein the exactness of the hill shape thus formed in the workpiece is lowered, compared with the original shape.

There has been, therefore, a demand for decreasing the grinding resistance, and for supplying the machining gap with sufficient amount of cooling water, thereby improving the quality of products.

SUMMARY OF THE INVENTION

To meet such demand a method of forming a series of hills and valleys alternately arranged at a predetermined pitch (one pitch being equal to a peak-to-peak interval at which hills are arranged) on the surface of a given workpiece, is improved according to the present invention in that it comprises the steps of: carrying out a first grinding on the workpiece with a saw-toothed grindstone having a series of hills and valleys alternately arranged at "N" pitches ("N" being equal two or more integer or whole number), the height measured from the bottom of the valley to the peak of the hill in the saw-toothed grindstone being taller than the corresponding height measured in the workpiece, the grinding being effected while the surface of the workpiece is being supplied with cooling water; moving the saw-toothed grindstone and/or the workpiece one pitch relative to each other to carry out a second grinding on the workpiece with the saw-toothed grindstone, the grinding being effected while the surface of the workpiece is being supplied with cooling water; and repeating the relative movement of one-pitch long-distance and subsequent grinding until the final "N"th cutting has been finished in case of "N" being three or more integer or whole number.

Said method may be carried out by using a machine which comprises at least means for holding the workpiece, means for rotating the saw-toothed grindstone against the workpiece, means for indenting or moving the saw-toothed grindstone and/or the workpiece one pitch relative to each other, and means for supplying the workpiece with cooling water. The workpiece may be a solar cell wafer.

In making saw-toothed grooves in the workpiece according to the present invention the whole of the hill-and-valley pattern of the grindstone cannot be pushed against the workpiece to full extent, thus leaving a relatively wide machining gap therebetween to permit a sufficient amount of cooling water to flow into the machining gap. Thus, the efficient cooling effect is assured.

Also, as many hills as required can be formed in the workpiece after repeating the groove-grinding "N" times, permitting hills of exact shape to be formed each time in the workpiece. The so formed hills have an apex as sharp as the original shape.

Other objects and advantages of the present invention will be understood from the following description of the saw-toothed grooving according to the present invention, which are illustrated in the accompanying drawings.

DETAILED DESCRIPTION OF PREFERRED EMBODIMENT

Figure 1:
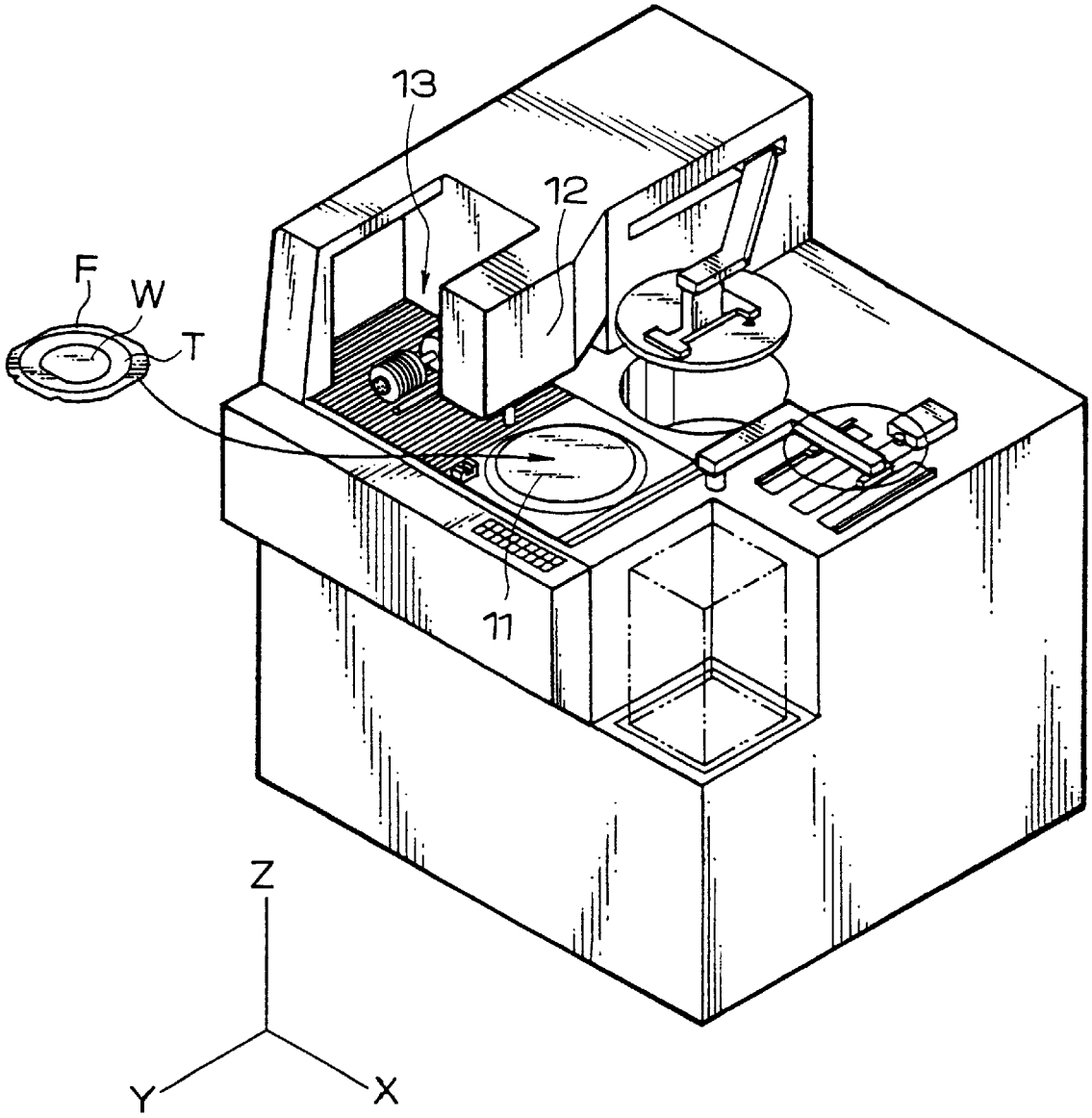
FIG. 1 is a grinding machine which can be used in making saw-toothed grooves on a given workpiece.

FIG.1 shows a grinding machine 10 which can be used in grinding workpieces W such as solar cell wafers according to the present invention. The wafer W is attached to a carrier F via an adhesive tape T, and then, the carrier F is sucked on a holder means 11. The holder means 11 is moved in the X-axis direction to be brought under the alignment means 12 for detecting the area to be ground. Then, the wafer W is brought in the vicinity of the grinding part 13 to be aligned therewith in respect of the so detected area.

Figure 2:
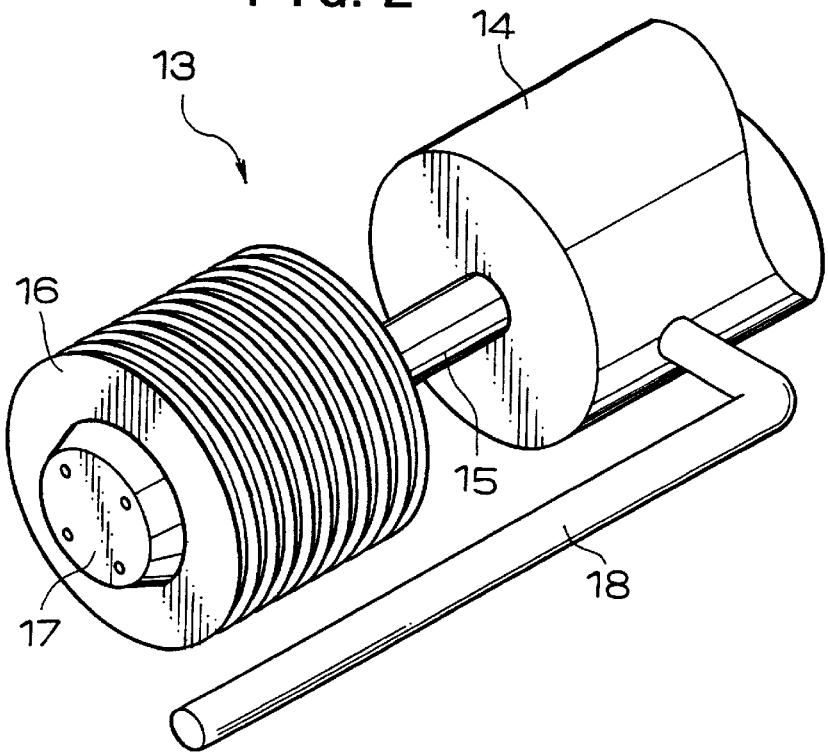
FIG. 2 is a perspective view of the grinding part of the grinding machine.

Referring to FIG.2, the grinding part 13 has a grindstone 16 fixed to a rotary spindle 15 by a flange 17. The spindle 15 is rotatably supported by the spindle housing 14. A coolant nozzle 18 is fixed to the spindle housing 14 to extend parallel to the grindstone 16. The coolant nozzle 18 has numerous small openings (not shown) made on one side for flushing cooling water toward the machining gap between the grindstone 16 and the workpiece W.

The grindstone 16 is a drum-like metal having a series of hills and valleys formed on its circumference, and these hills and valleys, which are arranged at regular intervals, have pulverized diamond electrodeposited thereon.

Figure 3:
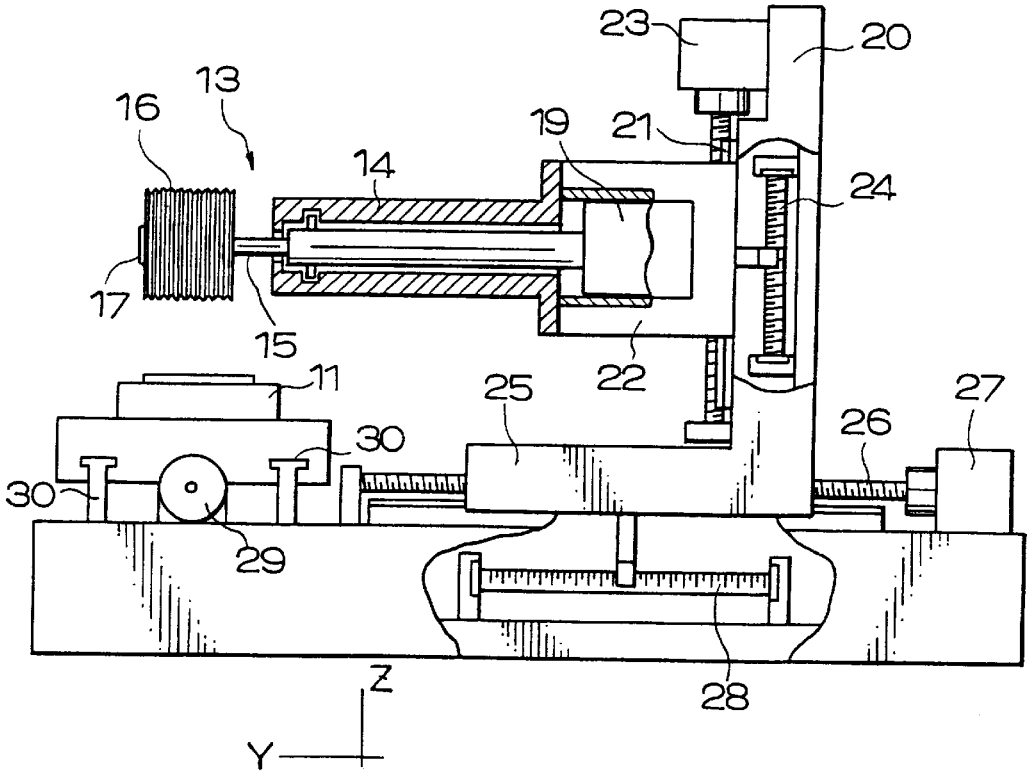
FIG. 3 illustrates the supporting mechanism for the grinding part.

Referring to FIG.3, the spindle 15 is rotated by an associated motor 19. The grinding part 13 is integrally connected to a supporting part 22, which is threadedly engaged with a first screw rod 21 extending vertically along an upright wall 20. The first screw rod 21 is rotated by an associated motor 23 to raise and descend the supporting part 22, and accordingly the grinding part 13 vertically in the z-axis direction. The vertical movement of the grinding part 13 in the z-axis direction is measured with a linear scale 24, which is attached to the upright wall 20, so that the vertical movement of the grinding part 13 may be controlled with precision in terms of the measurement.

The holder means 11 is driven on a pair of guide rails 30 by an associated motor 29 in the x-axis direction.

Now, the manner in which a solar cell wafer W held on the holding means 11 is ground to form a series of hills and valleys 31 and 32 on its surface (see FIG.4) is described.

Figure 5:
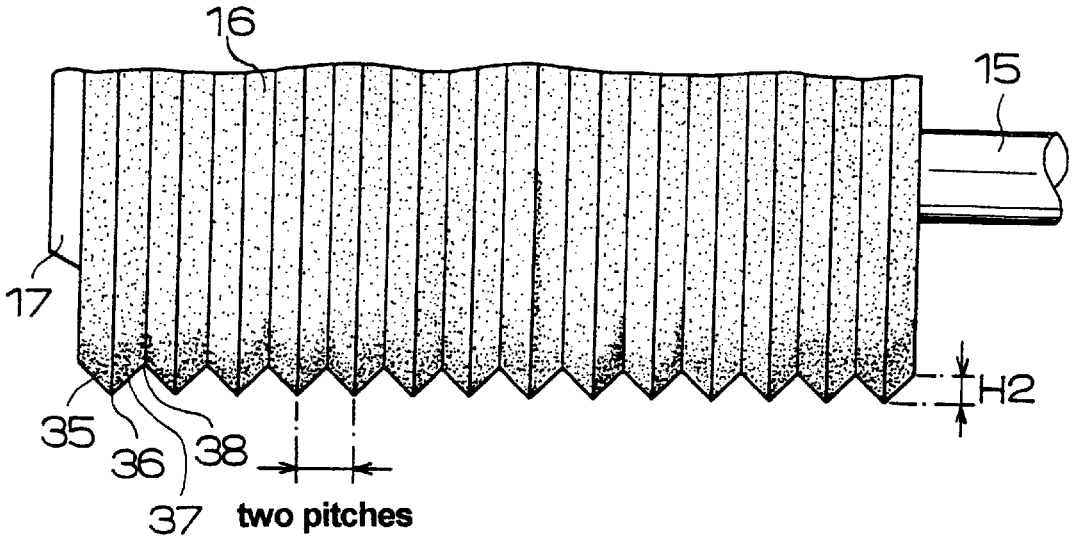
FIG. 5 is a front view of the grindstone used in making saw-toothed grooves according to the present invention.

The grindstone 16 to be attached to the grinding part 13 has the same saw-toothed pattern as that to be ground on the solar cell wafer W. The pitch distance, height, slope et al are determined considering ones of the solar cell wafer W. Specifically the saw-toothed grindstone 16 has a series of hills 35 and valleys 37 alternately arranged at the pitch equivalent to "N" pitches long on the solar cell wafer W. In the above "N" means two or more integer or whole number and one pitch is equal to the peak 33-to-peak 33 distance or the bottom 34-to-bottom 34 distance to be ground on the solar cell wafer W. In this particular embodiment "N" is two. Thus, the saw-toothed pattern of the grindstone 16 is composed of a series of hills 35 and valleys 37 arranged alternately at the intervals twice as long as the peak 33-to-peak 33 or bottom 34-to-bottom 34 distance, as seen from FIG.5.

The height H1 measured from the bottom 34 of the valley 32 to the peak 33 of the hill 31 in the saw-toothed pattern to be given to the wafer W (see FIG. 4) is shorter than the corresponding height H2 in the saw-toothed pattern in the grindstone 16 (H1<H2). Both saw-toothed patterns have same slopes in their hills and valleys.

Figure 6A:
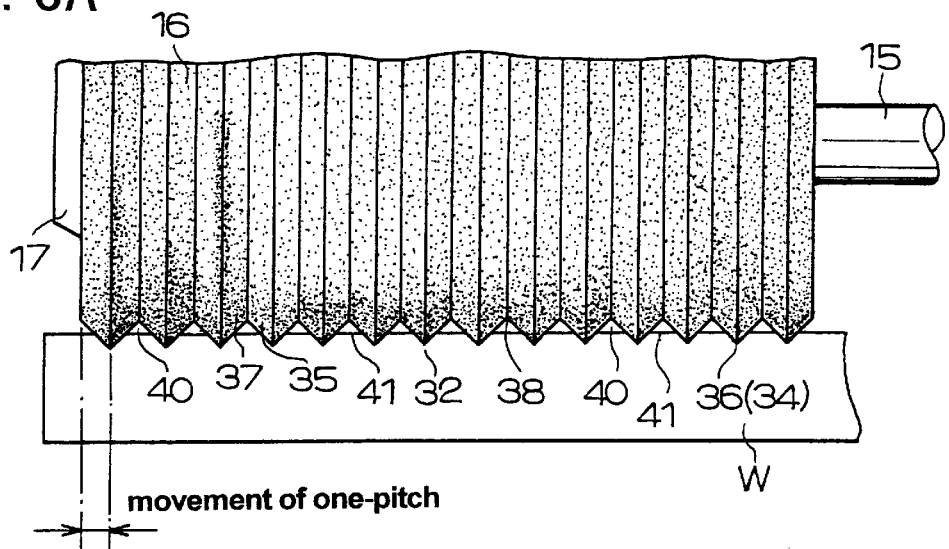
FIG. 6A illustrates how the first grinding is effected.

In grinding the solar cell wafer W to make a saw-toothed pattern on its surface, first the grindstone 16 is so aligned with the wafer W that the hill 35 at the front end of the grindstone 16 (i.e., the end close to the flange 17) may be put above the place at which the first valley 32 is to be made in the work piece W. Then, the cooling water jet is directed from the coolant nozzle 18 to the wafer W, and the grinding part 13 is lowered while the spindle 15 is rotated. Thus, the saw-toothed pattern of the grindstone 16 is transferred to the surface of the wafer W in such an inverted fashion that the hills 35 of the grindstone 16 correspond to the valleys 32 of the wafer W, as seen from FIG. 6A (first grinding step).

At the first grinding step only the valleys 32 are made on the workpiece W, leaving the valley-to-valley areas to be flat as indicated at 41. The bottom-to-bottom distance is equal to two pitches.

At the first grinding step the grinding is terminated before the hills 35 of the grindstone 16 have been completely buried in the wafer W, thus leaving a relatively large gap 40 between the wafer surface and the grindstone 16 to permit a sufficient amount of cooling water to flow in the machining gap 40. Thus, good cooling can be effected.

Figure 4:
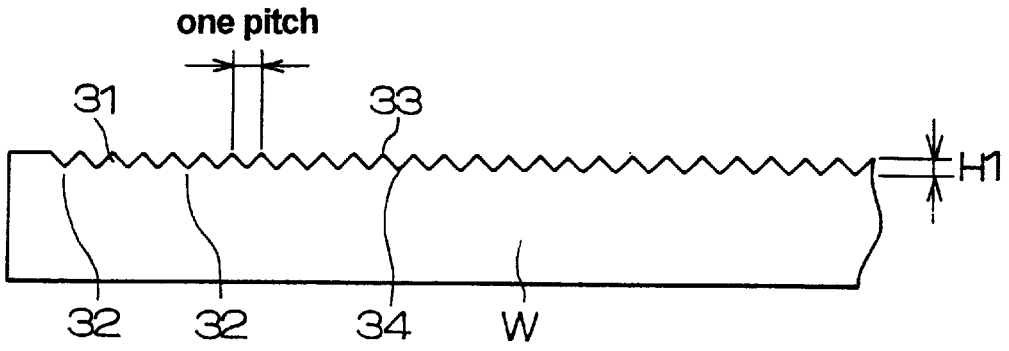
FIG. 4 illustrates the fragmentary end of a solar cell wafer having hills and valleys formed thereon.
Figure 6B:
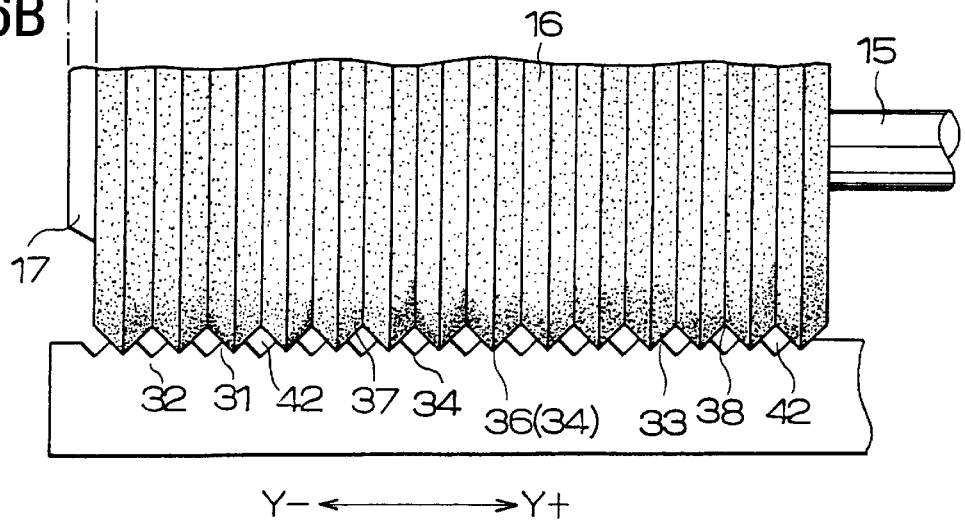
FIG. 6B illustrates how the second grinding is effected.
Figure 7:
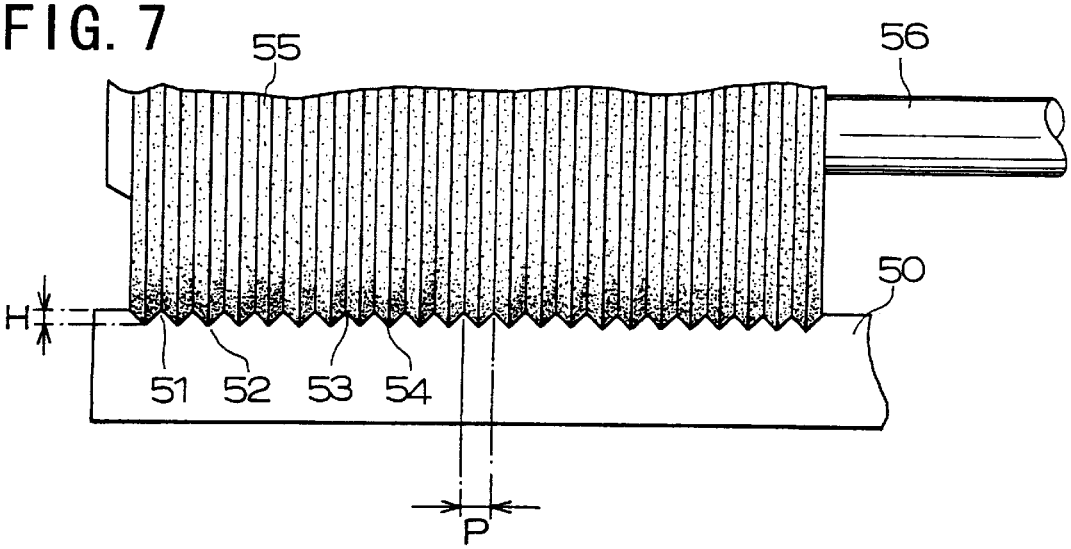
FIG. 7 illustrates how a series of saw-toothed grooves can be made on a workpiece according to a conventional method.

Next, the grinding part 13 is raised, and the grinding part 13 is moved one pitch in the +Y direction relative to the stationary wafer W as seen from FIG. 6B. Then, cooling water is supplied to the machining gap 40 to grind the workpiece W to the same depth as the first grinding. Thus, the flat, valley-to-valley regions 41 are grooved to form valleys 32, so that hills 31 may be formed between the new valleys and adjacent old valleys 32 (the second grinding). The so formed hills 31 have as sharp an apex 33 as the original hill shape. Thus, the saw-toothed wafer results as shown in FIG. 4.

The second grinding is terminated when the hills 35 of the saw-toothed pattern of the grindstone 16 are not buried completely, leaving a relatively large gap 42 between the grindstone 16 and the solar cell wafer W to allow a sufficient amount of cooling water to flow into the machining gap. Thus, effective cooling is attained, and accordingly the quality of the products is improved.

Contrary to this particular embodiment the relative movement between the solar cell wafer W and the grinding part 13 of the machine 10 may be effected by moving the holding means 11 in the Y-axis direction.

The hills 31 thus formed on the wafer w are one pitch apart from each other in terms of the peak 33-to-peak 33 distance (or the valleys 32 being one pitch apart from each other in terms of the bottom 34-to-bottom 34 distance).

When use is made of a grindstone which has a saw-tooth pitch two or more times as long as the saw-tooth pitch of the wafer, and a valley bottom-to-hill top height taller than that in the saw-tooth pattern of the wafer, the total area in which all saw-teeth are put in contact with the wafer can be reduced two or more times, compared with use of the grindstone having the same saw-tooth pattern as that of the wafer, and accordingly the resistance to grinding can be substantially reduced to permit the grindstone to rotate smoothly.

Still advantageously, use of such a grindstone having a saw-toothed pattern of increased pitch and amplitude assures that an increased machining gap be made between the grindstone and the solar cell wafer, thereby permitting a sufficient amount of cooling water to be supplied to the machining gap. The effective cooling thus attained makes a significant contribution to the improvement of product quality.

Also, advantageously use of such a grindstone of increased pitch and amplitude permits the converging slopes of each hill to be ground well with good precision, thus forming the sharp-angled apex in each hill.

If a grindstone having a saw-tooth pitch three times as large as the saw-tooth pitch of the wafer is used, the grinding part 13 is moved one pitch after the second grinding is finished, and then, the third, and final grinding is effected. Generally speaking, if use is made of a grindstone having a saw-tooth pitch "N" times as large as the saw-tooth pitch of the wafer, the relative movement of one pitch distance is repeated "N"−1 times, and the grinding is repeated "N" times.

What is claimed is:

1. A method of forming a series of hills and valleys alternately arranged at a predetermined pitch (one pitch being equal to a peak-to-peak interval at which hills are arranged) on the surface of a given workpiece comprising the steps of:

carrying out a first grinding on the workpiece with a saw-toothed grindstone having a series of hills and valleys alternately arranged at "N" pitches ("N" being two or more integer or whole number), the height measured from the bottom of the valley to the peak of the hill in the saw-toothed grindstone being taller than the corresponding height from the bottom of the valley to the peak of the hill to be formed on the surface of the workpiece, the grinding being effected while the surface of the workpiece is being supplied with cooling water;

moving the saw-toothed grindstone the workpiece one pitch relative to each other to carry out a second grinding on the workpiece with the saw-toothed grindstone, the grinding being effected while the surface of the workpiece is being supplied with cooling water; and repeating the relative movement of one-pitch long-distance and sequential grinding until the final "N"th grinding has been finished in case of "N" being three or more integer or whole number.

2. A method of forming a series of hills and valleys alternately arranged at a predetermined pitch on the surface of a given workpiece according to claim 1 wherein said method is carried out by using a machine which comprises at least means for holding the workpiece, means for rotating the saw-toothed grindstone against the workpiece, means for indenting or moving the saw-toothed grindstone or the workpiece one pitch relative to each other, and means for supplying the workpiece with cooling water.

3. A method of forming a series of hills and valleys alternately arranged at a predetermined pitch on the surface of a given workpiece according to claim 1 wherein the workpiece is a solar cell wafer.

* * * * *